US007726383B2

(12) United States Patent
Pircher et al.

(10) Patent No.: US 7,726,383 B2
(45) Date of Patent: Jun. 1, 2010

(54) METHOD FOR PRODUCING A MAGNESIUM HOT STRIP

(75) Inventors: Hans Pircher, Mülheim (DE); Rudolf Kawalla, Bobritzsch (DE)

(73) Assignee: ThyssenKrupp Stahl AG, Duisburg (DE)

( * ) Notice: Subject to any disclaimer, the term of this patent is extended or adjusted under 35 U.S.C. 154(b) by 616 days.

(21) Appl. No.: 10/415,451

(22) PCT Filed: Oct. 23, 2001

(86) PCT No.: PCT/EP01/12201

§ 371 (c)(1),
(2), (4) Date: Dec. 16, 2003

(87) PCT Pub. No.: WO02/36843

PCT Pub. Date: May 10, 2002

(65) Prior Publication Data

US 2004/0079513 A1 Apr. 29, 2004

(30) Foreign Application Priority Data

Oct. 23, 2000 (DE) ..... 100 52 423

(51) Int. Cl.
*B22D 11/12* (2006.01)

(52) U.S. Cl. ..... 164/476

(58) Field of Classification Search ..... 164/476, 164/475, 477
See application file for complete search history.

(56) References Cited

U.S. PATENT DOCUMENTS

| | | | | |
|---|---|---|---|---|
| 2,934,461 | A | 4/1960 | Burke et al. | |
| 3,014,824 | A | 12/1961 | Couling et al. | |
| 4,571,272 | A | 2/1986 | Grimes | |
| 5,316,598 | A * | 5/1994 | Chang et al. | 148/420 |
| 5,915,455 | A | 6/1999 | Kittilsen et al. | |
| 6,056,836 | A * | 5/2000 | Hoffman et al. | 148/437 |

FOREIGN PATENT DOCUMENTS

| | | |
|---|---|---|
| GB | 2 014 488 | 8/1979 |
| JP | 06293944 | 10/1994 |

* cited by examiner

*Primary Examiner*—Kevin P Kerns
(74) *Attorney, Agent, or Firm*—Proskauer Rose LLP

(57) ABSTRACT

The invention relates to a method for producing a magnesium hot strip, in which a melt from a magnesium alloy is continuously cast to form a roughed strip with a thickness of maximum 50 mm, and in which the cast roughed strip is hot-rolled directly from the cast heat at a hot-rolling initial temperature of at least 250° C. and maximum 500° C. to form a hot strip with a final thickness of maximum 4 mm, whereby in the first hot-rolling pass a reduction in the thickness of at least 15% is achieved. With the method according to the invention, magnesium sheets with improved deformability can be produced with reduced manufacturing effort and expenditure.

11 Claims, 1 Drawing Sheet

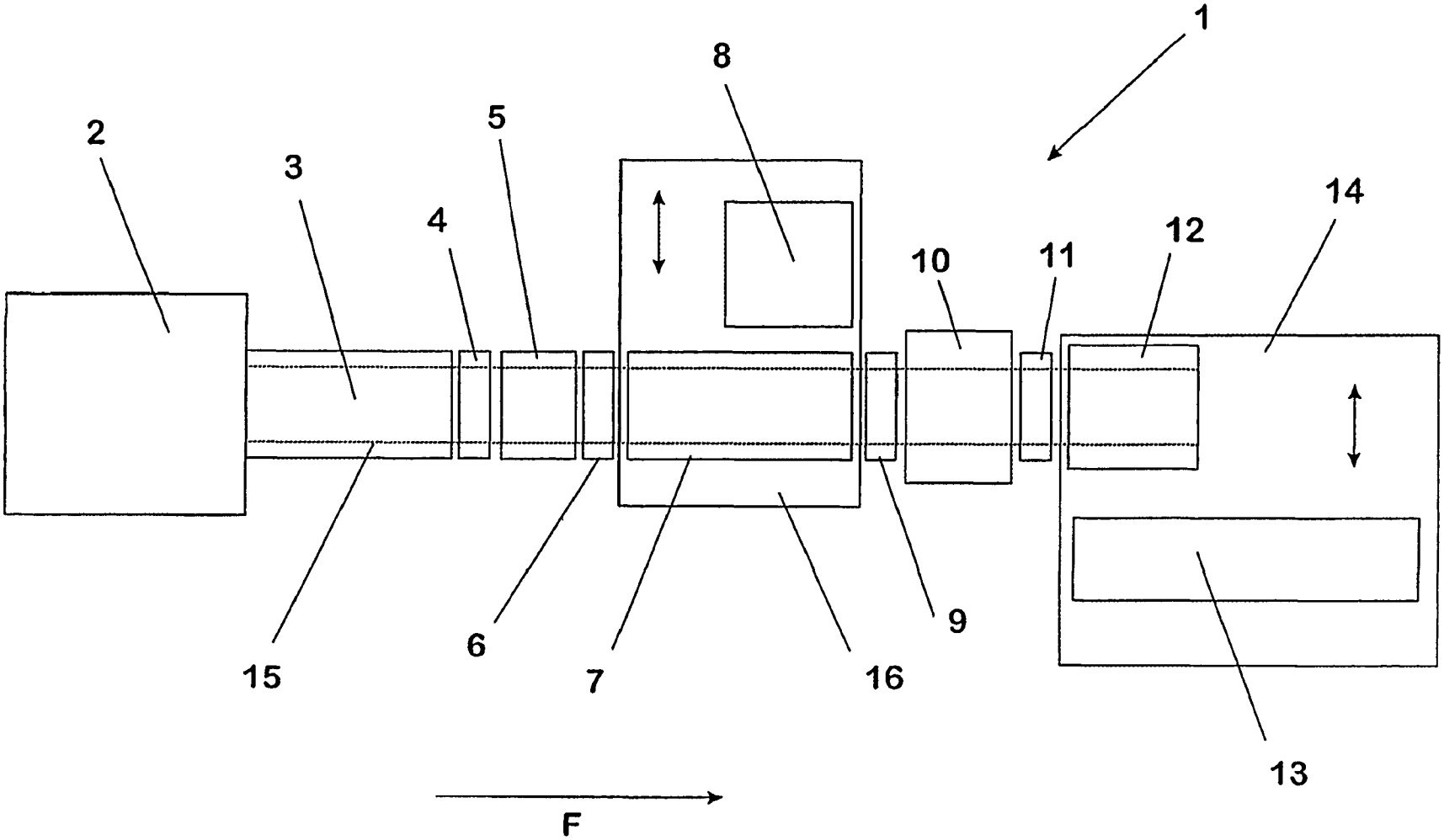
1
2
3
4
5
6
7
8
9
10
11
12
13
14
15
16
F

METHOD FOR PRODUCING A MAGNESIUM HOT STRIP

BACKGROUND OF THE INVENTION

The invention relates to a method for producing hot strip from magnesium wrought alloys. Magnesium is the metal with the lowest density, has strength characteristics similar to those of aluminium, and could substitute for this as a lightweight construction material. An important precondition for the progress of magnesium as a lightweight construction material, however, is the availability of economically-produced sheet materials. Magnesium sheets are at the present time only available on the market in small quantities and at high prices. This is explained by the substantial effort and expense which is required in hot-rolling sheets or strip of magnesium wrought alloys according to the present state of the art. This is described in detail in the Magnesium Taschenbuch (Aluminium-Verlag Düsseldorf, 2000, 1st edition, pp. 425 to 429). One basic problem with the hot-rolling of sheets of Mg wrought alloys lies in the fact that the conventional raw material from ingot casting or continuous casting solidifies in large grain and porous form, as well as containing pronounced segregations and coarse precipitations. The cast ingots are in many cases subjected to a homogenisation annealing process, and then hot-rolled at temperatures of between approx. 200 and 450° C. These procedures in most cases require in part repeated intermediate heating of the rolling stock, since otherwise wastage is incurred due to crack formation.

Attempts have been made to improve the deformability and the properties of a hot-rolled magnesium strip by the production of suitable raw materials, from which the hot strip is then rolled. Such a method is known, for example, from U.S. Pat. No. 5,316,598. According to the known method, magnesium powder compressed at temperatures from 150-275° C. solidifies rapidly. By extruding or forging, a raw material is produced from this ingot which is then rolled to form a sheet with a thickness of at least 0.5 mm. The rolling temperatures in this situation lie at between 200° C. and 300° C. The magnesium hot strip which is obtained in this way exhibits superplastic properties and at room temperature has high strength and good toughness in the rolling direction.

A disadvantage with the known method, however, is that for the manufacture of the raw material a magnesium powder is first produced, this powder is compressed, and an accelerated cooling process must then be carried out. The effort and expenditure in terms of apparatus and personnel associated with this leads to high manufacturing costs. In addition to this, it has been shown that the deformation of the raw material in the course of hot-rolling is difficult to master despite the elaborate production of the raw material.

In addition to the aforementioned state of the art, a method is known from JP 06293944 A for the manufacture of a magnesium sheet, in which a slab is first cast from a melt containing 0.5-1.5% REM, 0.1-0.6% zirconium, 2.0-4.0% zinc, and magnesium as the remainder. This slab is then hot-rolled in two stages, whereby in the second stage of the hot-rolling the rolling temperatures lie between 180-230° C., for preference 180-200° C., and a total deformation is achieved of 40-70%, for preference 40-60%. The strip obtained in this way is said to possess good deformability. The hot-rolling carried out in two stages, however, also makes the rolling process, and the temperature controlling which is to be maintained, elaborate and expensive and difficult to master.

SUMMARY OF THE INVENTION

Taking the prior art as described as a basis, the invention is based on the problem of providing a method with which, with reduced manufacturing effort and expenditure, magnesium sheets with improved deformability can be produced.

This problem is resolved according to the invention by a method for the production of a magnesium hot strip in which a melt of a magnesium alloy is continuously cast to form a roughed strip with a thickness of maximum 50 mm, and in which the cast rough strip is hot-rolled directly from the casting heat at a hot-rolling initial temperature of at least 250° C. and maximum 500° C. to form a hot strip with a final thickness of maximum 4 mm, whereby in the first roll pass of the hot-rolling, a thickness reduction of at least 15% is achieved.

According to the invention, a roughed strip is cast with a thickness of up to 50 mm, which, because of its low thickness cools rapidly, and in consequence has an improved, fine-grain and low-pore structure. Micro-segregations and macro-segregations are reduced to a minimum in this situation. In addition, primary precipitations possibly present, exist in fine, uniformly distributed form, as a result of which the formation of a fine microstructure is further supported. The especially fine-grain microstructure achieved in this way favours the deformability during the subsequent hot-rolling, in that it facilitates the softening which is favourable for further deformation. Also supported is the formation of a fine microstructure due to the reduction in thickness of at least 15% achieved in the first hot-roll pass. Due to the microstructure which is already present in the cast state and which is further refined in the rolling process, a magnesium sheet is obtained as a result of which the characteristics of use are substantially improved in comparison with conventionally produced sheets.

A further advantage of the continuously-effected casting of roughed strips of magnesium material used according to the invention, with subsequent rolling effected from the casting heat, lies in the fact that the proportion of scrap which has hitherto had to be taken into account in the manufacture of magnesium sheets is substantially reduced. Thanks to the use of a suitable remelting and casting technique, considerable independence can be achieved in the procurement of the raw material. In addition to this, the energy requirement is minimised with the cast-rolling technique used according to the invention, and a high degree of flexibility is guaranteed with regard to the range of the products created.

The method according to the invention can be carried out particularly economically in that the roughed strip is hot-rolled directly from the casting heat. Depending on the properties of the processed alloy and the apparatus circumstances, it may also be of advantage for the initial rolling temperature of the roughed strip to be adjusted in the course of a temperature equalization or balance process carried out before the hot-rolling. As a result of this temperature equalization or balance, a uniform temperature distribution is achieved in the roughed strip, and an additional microstructure homogenisation.

Oxidation of the strip surface and the formation of unwanted oxides in the microstructure can be reliably avoided in that the casting of the melt takes place under protective or inert gas in a suitably designed solidification device.

The microstructure formation can be further favoured if the reduction of the thickness in the first roll pass of the hot-rolling process amounts to at least 20%.

In order to ensure the deformability of the strip during the hot-rolling, the initial hot-rolling temperature should amount to at least 250° C.

The good deformability which already pertains with the roughed strip manufactured in accordance with the invention makes it possible for the hot strip to be finish rolled after the first pass continuously in several passes to the final thickness. Because of the deformation heat incurred, heating between the individual roll passes is not required.

If a rolling train for the finish rolling of the hot strip is not available, magnesium hot strip can also be manufactured in the manner according to the invention if the hot-rolling takes place in several passes in reversing manner.

If the need arises during hot-rolling to bridge idle or times, during which the continuous progress of the rolling process is not possible, it is to advantage if the hot strip is coiled on a hot coiler at least after the first pass, and is maintained at the individual deformation temperature. In the case of hot-rolling carried out in reversing manner, it is to advantage for the hot-rolled hot strip to be coiled onto a hot coiler between each roll pass, and to be maintained at the individual deformation temperature. The deformation temperature at which the hot strip is maintained on the coiler is for preference at least 300° C.

With regard to the deformation properties and the desired thickness of the finish-rolled strip, the overall degree of deformation achieved during the hot-rolling should amount to at least 60%.

The method according to the invention can be carried out for preference with the use of a magnesium wrought alloy containing up to 10% aluminium, up to 10% lithium, up to 2% zinc, and up to 2% manganese. The addition to the alloy of zirconium or cerium in amounts of up to 1% in each case can make a contribution to fine-grain formation in the solidification microstructure.

BRIEF DESCRIPTION OF THE DRAWING

The invention is described in greater detail hereinafter on the basis of embodiment examples. The single FIGURE shows a diagrammatic arrangement of a cast-rolling plant 1 for roughed slab thicknesses of down to 25 mm, in a view from above.

DETAILED DESCRIPTION OF THE INVENTION

The cast-rolling plant 1 comprises, in the conveying direction F, arranged behind one another, a melting furnace 2, a solidification installation 3, a first driver device 4, a set of shears 5, a second driver device 6, a homogenisation furnace 7, a first coiling device 8, a third driver unit 9, a reversing stand of rolls 10, a fourth driver unit 11, a fourth coiling device 12, and a roller table 13.

The coiling device 12 and the roller table 13 are set up on a platform 14, which is capable of being moved transversely to the conveying direction F in such a way that, in a first operating position, the coiling device 12, and, in a second operating position, the roller table 13, are arranged at the end of the conveying path 15 of a magnesium strip produced in the cast-rolling plant 1. In the same way, the homogenisation furnace 7 and the coiling device 8 are arranged on a platform 16, so that in each case one of these devices is arranged in a first operational position next to the conveying path 15, and in a second operating position it is arranged in the conveying path of the magnesium strip which is to be produced. At the beginning of the production of a magnesium hot strip, the homogenisation furnace 7 and the coiler 12 are located in the conveying path 15, while the coiler 8 and the roller table 13 are arranged next to the conveying path 15.

The coiling devices 8 and 12 are equipped with heating devices, not shown here, by means of which the strip wound onto the coilers, likewise not shown, can be maintained at the individual deformation temperature in each case, until the next rolling pass is carried out.

Inside the solidification installation 3, under a protective or inert gas atmosphere, a melt is continuously cast to form a roughed strip, with the exclusion of oxygen. Typical alloys for these melts are indicated in Table 1 below:

TABLE 1

| | Chemical composition in % by mass | | | | | | | |
|---|---|---|---|---|---|---|---|---|
| Alloy | AL | Mn | Zn | Si | Cu | Ni | Fe | Σ others |
| AZ31 | 2.5 | 0.35 | 0.85 | 0.02 | 0.002 | 0.018 | 0.003 | <0.02 |
| AZ61 | 5.91 | 0.22 | 0.84 | 0.022 | 0.005 | 0.001 | 0.002 | <0.02 |
| AM20 | 2.0 | 0.4 | 0.15 | 0.04 | 0.05 | <0.001 | 0.003 | <0.02 |
| AM50 | 4.8 | 0.35 | 0.18 | 0.08 | 0.06 | <0.002 | 0.003 | <0.02 |

The use of HP (high purity) magnesium alloys has proved to be particularly advantageous. Such alloys contain, for example, less than 10 ppm Ni, less than 40 ppm Fe, and less than 150 ppm Cu.

The solidified roughed strip emerging from the solidification installation 3 is cropped by means of the shears 5 and conveyed by the driver units 4 and 6 on the conveying path 15 through the homogenisation furnace 7. Temperature equalization or balancing takes place there, in the course of which an initial rolling temperature is established uniformly distributed over the cross-section of the roughed strip, which lies in the range from 250-500° C.

The roughed strip, temperature-controlled in this manner, is then conveyed by the driver unit 9 into the reversing stand of rolls 10, and is subjected there to a first hot roll pass. The reduction in thickness which is thereby achieved amounts to at least 15%. The hot strip leaving the stand of rolls is coiled by the coiler device 12 and is maintained at the optimum deformation temperature for the next deformation pass.

After the conclusion of the first roll pass, the platform 16 is brought into the operating position, in which the coiling device 8 stands in the conveying path 15. The hot strip is then rolled in several passes to its final thickness of less than 4 mm, whereby in each case it is wound up alternately by the coiling devices 8 and 12 respectively, and is maintained at the individual deformation temperature in each case. This temperature is in each case above 250° C.

Before the last rolling pass, the platform 14 is moved into that operating position in which the roller train 13 is arranged at the end of the conveying path 15. The finish rolled magnesium hot strip which leaves the reversing stand of rolls after the last pass is guided via the roller table 13 to further processing.

Typical properties at ambient temperature of the magnesium hot strips produced in the manner described in the cast-rolling plant 1 from the alloys listed in Table 1 are indicated in Table 2. The sheet thickness in each case was between 1.2 and 1.5 mm

TABLE 2

| Alloy | Mechanical properties at ambient temperature | | | | | | |
|---|---|---|---|---|---|---|---|
| | $R_{P02}$ [MPa] | $R_m$ [MPa] | $A_g$ [%] | $A_5$ [%] | $r_m$ | Δr | n*) |
| AZ31 | 155 | 250 | 18 | 25 | 1.7 | 0.3 | 0.22 |
| AZ61 | 165 | 270 | 15 | 20 | 1.5 | 0.1 | 0.2 |
| AM20 | 115 | 190 | 14 | 18 | 1.4 | 0.1 | |
| AM50 | 130 | 205 | 12 | 16 | 1.4 | 0.1 | |

*)Determined in the range between 2% to Ag

It has been shown that the strips produced in accordance with the invention have a fine microstructure and, as a result, excellent deformability. It has accordingly been found that the properties of sheets manufactured according to the invention are at least 20% better than the individual properties of conventionally-produced sheets.

REFERENCE IDENTIFICATION

F Direction of conveying
1 Casting-rolling plant
2 Melt furnace
3 Solidification installation
4 Driver device
5 Shears
6 Driver device
7 Homogenisation furnace
8 Coiler device
9 Driver unit
10 Reversing stand of rolls
11 Driver unit
12 Coiler device
13 Roller table
14 Platform
15 Conveying path
16 Platform

The invention claimed is:

1. A method for producing a magnesium hot strip, comprising:

(a) continuously casting a melt of a magnesium alloy in a casting heat to form a roughed strip having a maximum thickness of 50 mm, and (b) hot rolling the cast roughed strip directly from the casting heat at a hot-rolling initial temperature of at least 250° C. up to a maximum of 500° C. to form a hot strip having a maximum final thickness of 4 mm, (c) whereby in the first hot-rolling pass, a reduction in thickness of at least 15% is achieved.

2. The method according to claim 1, wherein the casting of the melt takes place under a protective or inert gas.

3. The method according to claim 1, wherein the roughed strip is brought to the hot-rolling initial temperature before the hot-rolling in the course of a temperature equalization.

4. The method according to claim 1, wherein the reduction in thickness in the first hot-rolling pass amounts to at least 20%.

5. The method according to claim 1, wherein the hot strip is continuously finish-rolled after the first pass to final thickness in several passes.

6. The method according to claim 5, wherein the hot strip is coiled on a hot coiler at least after the first pass, and is maintained at a deformation temperature.

7. The method according to claim 6, wherein the deformation temperature at which the hot strip is maintained on the coil amounts to more than 300° C.

8. The method according to claim 1, wherein the hot-rolling takes place in several passes in reversing fashion.

9. The method according to claim 8, wherein the reversing hot-rolled hot strip is coiled between each rolling pass on a hot coiler.

10. The method according to claim 1, wherein the overall degree of deformation achieved during hot-rolling amounts to at least 60%.

11. The method according to claim 1, wherein the magnesium alloy is a wrought alloy with up to 10% aluminum, up to 10% lithium, up to 2% manganese, up to 1% zirconium, and up to 1% cerium.

* * * * *